US007861784B2

(12) United States Patent
Burleson et al.

(10) Patent No.: US 7,861,784 B2
(45) Date of Patent: Jan. 4, 2011

(54) SYSTEM AND METHOD OF CONTROLLING SURGE DURING WELLBORE COMPLETION

(75) Inventors: John D. Burleson, Denton, TX (US); John H. Hales, Frisco, TX (US); Clinton C. Quattlebaum, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 10 days.

(21) Appl. No.: 12/237,749

(22) Filed: Sep. 25, 2008

(65) Prior Publication Data

US 2010/0071895 A1 Mar. 25, 2010

(51) Int. Cl.
*E21B 43/11* (2006.01)
*E21B 37/00* (2006.01)

(52) U.S. Cl. ..... 166/297; 166/55.1; 166/311; 175/4.54

(58) Field of Classification Search ..... 166/297, 166/55, 55.1, 311; 175/4.54
See application file for complete search history.

(56) References Cited

U.S. PATENT DOCUMENTS 3,831,680 A * 8/1974 Edwards et al. ..... 166/311
4,800,958 A * 1/1989 Haugen et al. ..... 166/55.1
6,173,783 B1 * 1/2001 Abbott-Brown et al. .... 166/370
6,598,682 B2 7/2003 Johnson et al.
7,121,340 B2 10/2006 Grove et al.
7,182,138 B2 2/2007 Behrmann et al.
7,243,725 B2 7/2007 George et al.
7,287,589 B2 10/2007 Grove et al.
7,428,921 B2 * 9/2008 Grove et al. ..... 166/55.1
7,478,555 B2 * 1/2009 Zhan et al. ..... 73/152.55
7,533,722 B2 * 5/2009 George et al. ..... 166/299
2002/0017386 A1 * 2/2002 Ringgenberg et al. .. 166/250.17
2003/0089498 A1 5/2003 Johnson et al.
2003/0150646 A1 8/2003 Brooks et al.
2004/0089449 A1 5/2004 Walton et al.
2004/0159432 A1 8/2004 Johnson et al.
2004/0159434 A1 8/2004 Johnson et al.
2004/0231840 A1 * 11/2004 Ratanasirigulchai et al. ..... 166/259
2005/0061506 A1 3/2005 Grove et al.
2005/0167108 A1 8/2005 Chang et al.
2005/0247449 A1 * 11/2005 George et al. ..... 166/260
2007/0034369 A1 * 2/2007 Ratanasirigulchai et al. .. 166/63
2007/0050145 A1 * 3/2007 Zhan et al. ..... 702/6
2007/0079960 A1 4/2007 Grove et al.
2007/0162235 A1 * 7/2007 Zhan et al. ..... 702/6
2007/0240873 A1 10/2007 George et al.
2008/0105430 A1 5/2008 Cuthill
2009/0151952 A1 * 6/2009 Walton ..... 166/305.1
2010/0071895 A1 * 3/2010 Burleson et al. ..... 166/250.01

FOREIGN PATENT DOCUMENTS

GB 2439182 A * 12/2007

* cited by examiner

*Primary Examiner*—Jennifer H Gay
(74) *Attorney, Agent, or Firm*—Michael W. Piper

(57) ABSTRACT

A downhole oilfield completion method comprises determining a surge profile for a wellbore and assembling a downhole completion tool having an interior surge volume and comprising a surge attenuation system operable to reduce a surge of the downhole completion tool based at least in part on the surge profile. The method also comprises running the downhole completion tool into the wellbore and surging the wellbore by admitting wellbore fluid into the interior surge volume, the surge reduced at least in part by the surge attenuation system.

24 Claims, 8 Drawing Sheets

SYSTEM AND METHOD OF CONTROLLING SURGE DURING WELLBORE COMPLETION

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

A well may be completed and brought into production, in part, by running a downhole oilfield tool comprising a perforation gun into the wellbore and firing the perforation gun. The perforation gun comprises explosive charges which, when ignited, pierce any wellbore casing and create a plurality of perforation tunnels in the formation surrounding the wellbore. Thereafter hydrocarbons may flow from the formation into the perforation tunnels, into the wellbore, and then rise up the wellbore to be produced at the surface.

The energy delivered by the explosive charges to the formation creates debris and may shatter the formation proximate to the perforation tunnels. Under some conditions, this debris may, to some extent, clog and/or block the perforation tunnels. It may be desirable, under some conditions, to provide for a surge of fluid into the downhole oilfield tool to encourage a flushing operation that will flush or sweep at least part of the debris out of the perforation tunnels. A surge chamber contained in the downhole oilfield tool comprising an enclosed volume of fluid or gas at a pressure lower than the wellbore pressure may be suddenly opened after the perforation gun has been fired, providing for a surge of wellbore fluids into the surge chamber, creating a transient under pressure in the wellbore that is less than the formation pressure. The pressure differential between the formation and the wellbore may cause fluid flow from the formation into the wellbore, flushing and/or sweeping the debris out of the perforation tunnels and clearing the perforation tunnels.

In some wellbores, multiple production zones may be contemplated. In this case, the downhole oilfield tool may comprise more than one perforation gun. The perforation guns may be separated by one or more spacer sub-assemblies that displace the perforation guns by a distance corresponding to the distance between the several production zones. In some cases, a plurality of perforation guns may be coupled to each other to extend the perforation zone of a single production zone.

SUMMARY

In an embodiment, a downhole oilfield completion method is provided. The method comprises determining a surge profile for a wellbore and assembling a downhole completion tool having an interior surge volume and comprising a surge attenuation system operable to reduce a surge of the downhole completion tool based at least in part on the surge profile. The method also comprises running the downhole completion tool into the wellbore and surging the wellbore by admitting wellbore fluid into the interior surge volume, the surge reduced at least in part by the surge attenuation system.

In another embodiment, an oilfield downhole completion tool is provided. The oilfield downhole completion tool comprises a surge chamber sub-assembly containing at least one constrictor plate to reduce the in-flow of wellbore fluid within the surge chamber when a well is surged.

In another embodiment, a downhole oilfield tool is disclosed. The downhole oilfield tool comprises a first perforation gun and a surge chamber sub-assembly comprising a pre-determined volume of filler material and a surge volume at approximately atmospheric pressure. The downhole oilfield tool also includes a surge vent sub-assembly coupled to the first perforation gun and coupled to the surge chamber sub-assembly, wherein the surge vent sub-assembly is operable to open a surge vent in association with detonating the first perforation gun, thereby admitting a surge of a fluid in the wellbore into the surge chamber sub-assembly.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
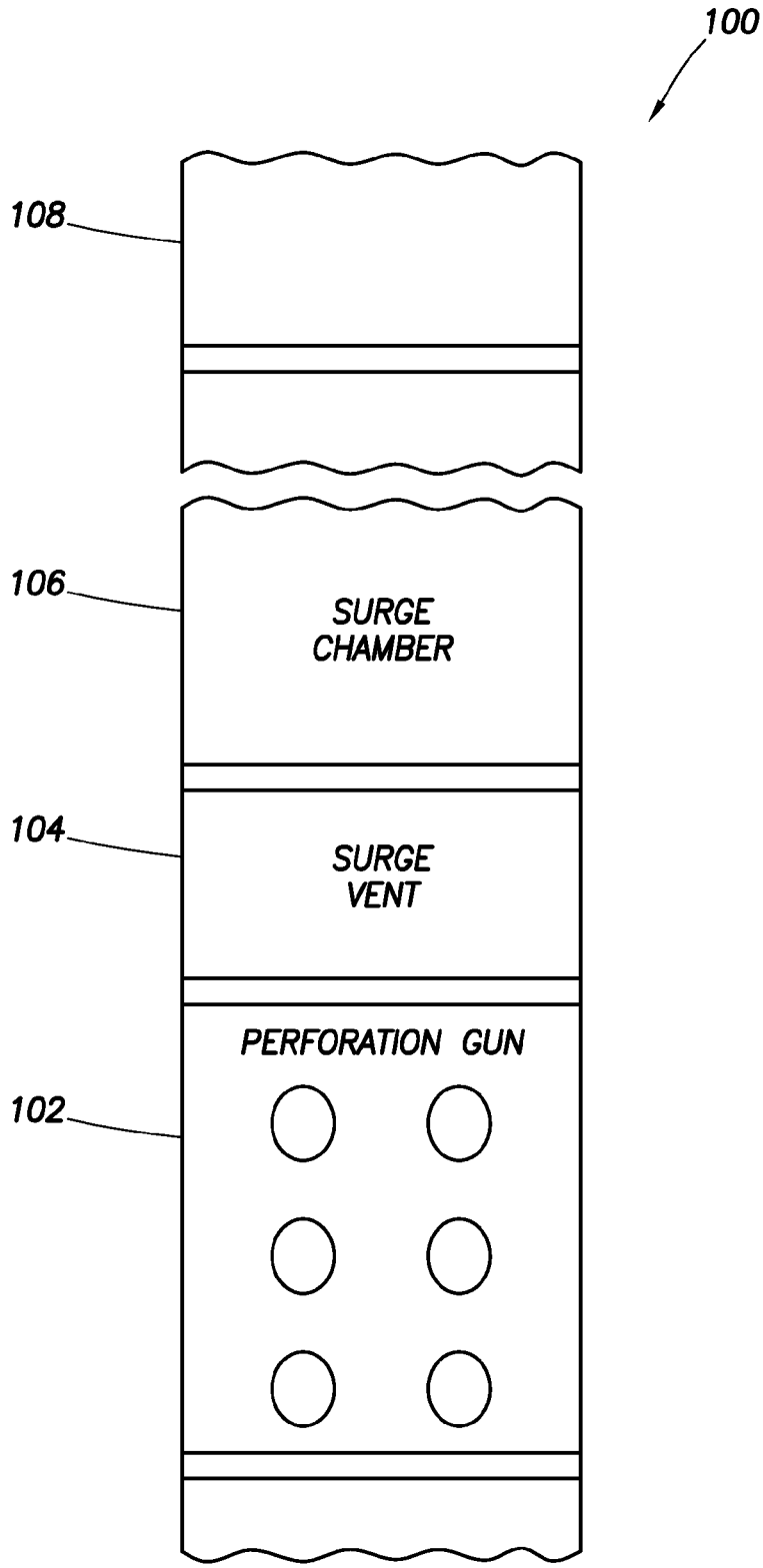
FIG. 1 is an illustration of a downhole completion tool according to an embodiment of the disclosure.

It should be understood at the outset that although illustrative implementations of one or more embodiments are illustrated below, the disclosed systems and methods may be implemented using any number of techniques, whether currently known or in existence. The disclosure should in no way be limited to the illustrative implementations, drawings, and techniques illustrated below, but may be modified within the scope of the appended claims along with their full scope of equivalents.

Creating a surge of fluid flow from the formation into perforation tunnels, from perforation tunnels into the wellbore, and from the wellbore into a surge chamber in a downhole completion tool by suddenly opening the surge chamber may help to clear debris created during the explosion of perforation gun charges, thereby increasing the effectiveness of perforation and increasing the production of hydrocarbons from the perforated formation. Excessive surge, however, may cause harm in a number of ways. For example, over surge may create such a flow from the formation into the perforation tunnels that the perforation tunnels collapse, thereby diminishing the effectiveness of the perforations. Additionally, over surge may sweep such a quantity of debris into the wellbore that the work string containing the perforation gun gets stuck in the wellbore. The damage caused by over surge may entail performing costly services to remediate, at least partly, the damages. The damage caused by over surge may result in under performance or even total loss of a well.

Technology tools, for example computer programs, are able to design surge profiles based on known well parameters. A surge profile may be determined by a computer program executing on a desktop computer, a workstation computer, or other general purpose computer. The surge profile may be defined in a number of different ways including defining a pressure balance versus time profile and/or a surge in-flow volume versus time profile. The computer programs may determine the surge profiles in part based on properties of the perforated formation such as formation material, formation pressure, formation density, and other formation properties. The surge profiles may further be determined in part based on pressure conditions in the wellbore immediately prior to firing the perforation gun and/or guns, for example an over balance wellbore pressure or an under balance wellbore pressure.

Given a surge profile, a volume of the surge chamber and/or in-flow rate of the surge chamber can be determined. In some cases, the volume of surge chambers may need to be reduced and/or in-flow rate of wellbore fluids into surge chambers may need to be attenuated to achieve the surge profile. For example, if a spacer or a plurality of spacers are used to locate a plurality of perforation guns to perforate separate production zones of a formation, the interior volume of the spacer(s) may provide the surge volume. Depending upon the number of spacers used, the surge volume may be excessive.

Generally, a variety of surge attenuation devices and/or components may be applied, singly or in combination, to achieve the surge profile when perforating a wellbore. The surge attenuation device and/or devices may be referred to as a surge attenuation system. The surge attenuation system may include a variety of techniques and devices including, but not limited to, one or more restrictors to restrict the rate of in-flow of wellbore fluid into an interior of a surge chamber, one or more isolators to close off a portion of the interior of the surge chamber to wellbore fluid, and filler placed in the surge chamber to reduce the volume of the surge chamber. In part, the use of filler placed in the surge chamber may also reduce the in-flow rate of wellbore fluid into the interior of the surge chamber. The restrictor may be provided by one or more constrictor plates located inside the surge chamber to restrict and/or limit the in-flow rate of wellbore fluids within and/or into the surge chamber. In an embodiment, the constrictor plate and/or plates may be located at different points within the surge chamber to define a different free volume of the surge chamber and a different restricted volume of the surge chamber. For example, the constrictor plate may be located at a lower point in the surge chamber defining a free volume corresponding to about ⅓ of the volume of the surge chamber and a restricted volume corresponding to about ⅔ of the volume of the surge chamber. Alternatively, the constrictor plate may be located at a higher point in the surge chamber defining a free volume corresponding to about ⅔ of the volume of the surge chamber and a restricted volume corresponding to about ⅓ of the volume of the surge chamber. It is understood that the constrictor plate also may be located at different points in the surge chamber defining different ratios between the free volume and the restricted volume of the surge chamber. The restrictor may also be provided by a surge vent selected to restrict and/or limit the in-flow rate of wellbore fluids into the surge chamber, for example selected to restrict the in-flow rate of wellbore fluids to substantially achieve a pre-determined surge profile. Isolators or bulkheads may be installed in the interior of the surge chamber to block off portions of the interior volume of the surge chamber to in-flow of wellbore fluids, thereby reducing the volume of the surge chamber accessible to surge flow. The surge attenuation system may further include placing filler material into the surge chamber to reduce the volume of the surge chamber accessible to surge flow. Filler material may include metal rods, proppant material, metal balls, and liquid. As mentioned above, in some cases filler material may provide a dual surge attenuation effect of both reducing the volume of the surge chamber and also reducing the in-flow rate of wellbore fluid. In some contexts, surge may refer to in-flow volume and/or rate of wellbore fluids into an interior volume of the downhole wellbore completion tool.

In an embodiment, a portion of the available surge chambers may be blocked by bulkhead detonation technology that promotes propagation of a detonation signal while isolating fluid flow across a bulkhead and/or isolator. The detonation signal may be any of a thermal energy signal, for example thermal energy propagating through a detonator cord such as PRIMACORD, or an electrical signal that provides an electrical command or an electrical impulse to initiate a detonation. In another embodiment, a flow reducing device may be assembled into one or more spacers to attenuate the rate of fluid in-flow. The surge attenuation system may comprise an adjustable surge vent, the surge vent being configurable to open to different fractions from a fully closed to a fully opened position. Alternatively, a surge vent may be selected for assembly into a completion tool based on its in-flow rate. For example, a first surge vent having a first in-flow rate under a standard pressure differential condition may be selected to achieve a first surge profile; a second surge vent having a second in-flow rate under the standard pressure differential condition may be selected to achieve a second surge profile; and a third surge vent having a third in-flow rate under the standard pressure differential condition may be selected to achieve a third surge profile. The specific in-flow rate associated with a surge vent may be referred to, in some contexts, as a pre-defined rate.

In yet another embodiment, filler material may be included in one or more spacers to reduce the volume of the surge chambers, for example metal rods, metal balls, proppant material, liquid, and other filler material. In an embodiment, a liquid such as a substantially uncompressible fluid may be used as filler material. Each of these embodiments may be used to adapt surge chambers to provide substantially the designed and/or pre-defined surge profile determined by the technology tool described above. By using a surge attenuation system to reduce the effective volume of the surge chamber and/or to reduce the rate of wellbore fluid flow into the surge chamber, it may be possible to use standard size surge chambers, for example standard sized spacers already being sent downhole, rather than custom manufactured surge chambers to build a tool string for use in perforating a wellbore.

Turning now to FIG. 1, a downhole oilfield completion tool 100 is described. The completion tool 100 comprises a first perforation gun 102, a surge vent sub-assembly 104, a first surge chamber 106, and a work string 108. In an embodiment, the completion tool 100 may comprise additional components below the first perforation gun 102, including, but not limited to, additional perforation guns, additional surge vents, and additional surge chambers. The first perforation gun 102 is coupled to the surge vent sub-assembly 104. The surge vent sub-assembly 104 is coupled to the first surge chamber 106. The first surge chamber 106 is coupled to the work string 108. The completion tool 100 is run into a wellbore to perform completion actions including perforating a wellbore and, where present, a casing and cement layer. In some embodiments, one or more of the above components and/or sub-assemblies may be combined. For example, in some embodiments, the surge vent sub-assembly 104 may be combined with the first surge chamber 106. Additionally, in some embodiments, the relative location of the several components may be reordered in a different combination.

The first perforation gun 102 may comprise a plurality of explosive charges whose purpose is to create perforation tunnels into a formation surrounding the wellbore. A detonating cord, for example PRIMACORD, may be employed to convey a controlling ignition to the explosive charges and cause them to detonate, perforating the wellbore.

The surge vent sub-assembly 104 includes a vent that is configured to open to admit wellbore fluids into the first surge chamber 106. In an embodiment, the surge vent sub-assembly 104 comprises a propellant that, when ignited, drives a piston that actuates a port, for example a sliding sleeve, to an open position. In an embodiment, the surge vent sub-assembly 104 receives an ignition signal, for example a thermal energy signal or an electrical signal, in association with the firing of the first perforation gun 102. In an embodiment, the propellant in the surge vent sub-assembly 104 may fire very shortly after the first perforation gun 102 fires. In another embodiment, however, the surge vent sub-assembly 104 is not coupled to any first perforation gun 102 and receives an ignition signal that is independent of perforation gun firing activities. An exemplary embodiment of the surge vent sub-assembly 104 is described in more detail in U.S. Pat. No. 7,243,725 by George et al, entitled "Surge Chamber Assembly and Method for Perforating in Dynamic Underbalanced Condition," which is hereby incorporated by reference herein in its entirety.

Figure 8:
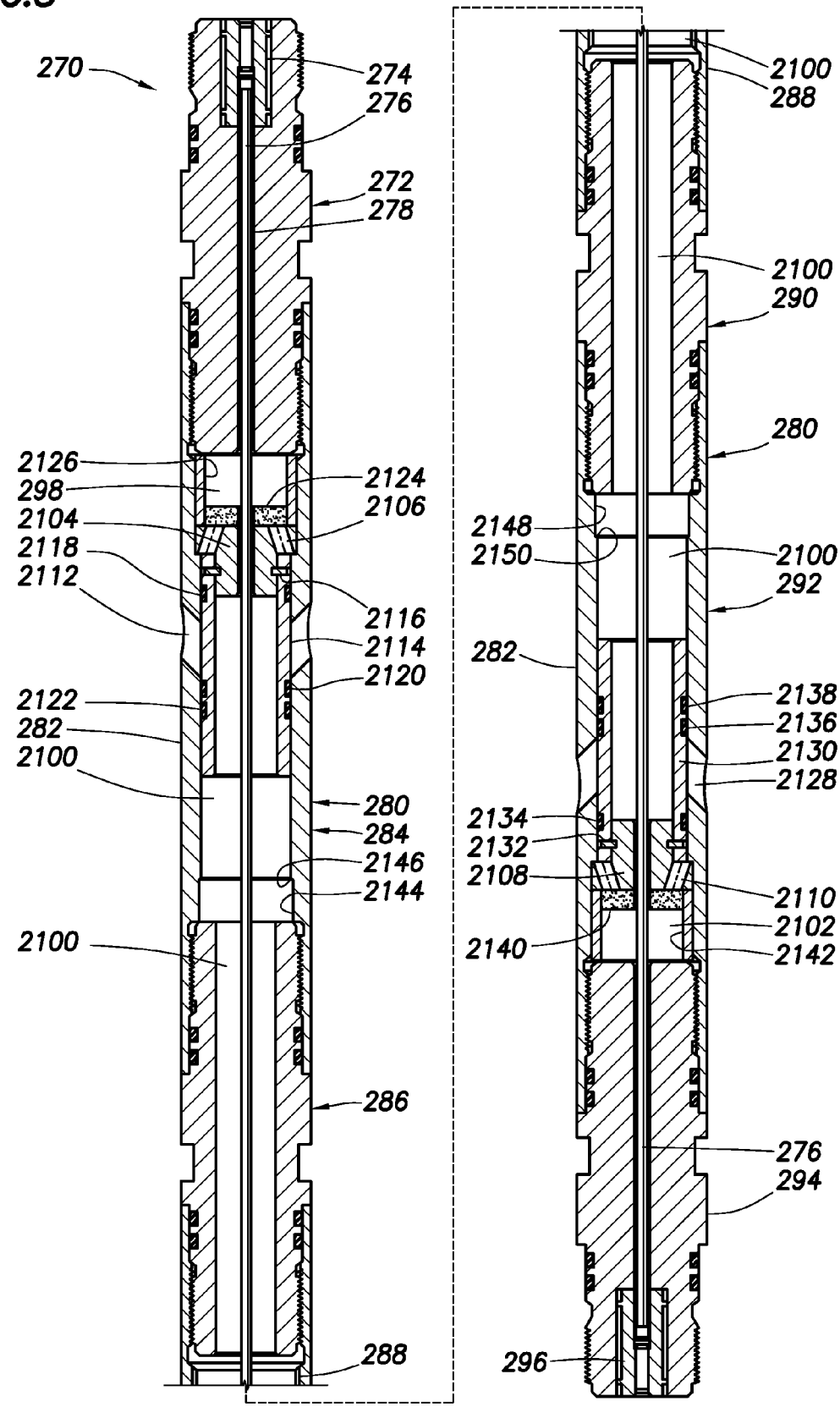
FIG. 8 is a half sectional view of a surge chamber assembly according to an embodiment of the disclosure.

FIG. 8 depicts a surge chamber assembly 270 according to the present invention that is generally designated 270. Surge chamber assembly 270 includes an upper tandem 272 that may be connected to a perforating gun as part of a gun string. Positioned within upper tandem 272 is a support member 274 that receives a booster positioned at the upper end of a detonating cord 276. Detonating cord 276 is positioned within a detonation passageway 278 that traverses the length of surge chamber assembly 270. As depicted, a housing 280 having an exterior 282 is threadably and sealingly coupled to upper tandem 272.

Housing 280 includes upper housing section 284, connector 286, intermediate housing section 288, connector 290 and lower housing section 292, each of which are threadably and sealingly coupled to the adjacent housing section. Lower housing section 292 is threadably and sealingly coupled to lower tandem 294. A support member 296 is positioned within lower tandem 294 that receives the booster positioned at the lower end of detonating cord 276. Lower tandem 294 may be connected to a perforating gun at its lower end. As such, a detonation of the detonating cord in a perforating gun above surge chamber assembly 270 will be propagated through surge chamber assembly 270 to a perforating gun below surge chamber assembly 270 via detonating cord 276.

It should be apparent to those skilled in the art that the use of directional terms such as top, bottom, above, below, upper, lower, upward, downward, etc. are used in relation to the illustrative embodiments as they are depicted in the figures, the upward direction being toward the top of the corresponding figure and the downward direction being toward the bottom of the corresponding figure. As such, it is to be understood that the downhole components described herein may be operated in vertical, horizontal, inverted or inclined orientations without deviating from the principles of the present invention.

In a downhole operational embodiment, exterior 282 includes the wellbore, perforations and portions of the formation that are proximate housing 280. The interior of housing 280 includes a combustion chamber 298, a surge chamber 2100 and a combustion chamber 2102. A flange 2104 is positioned between combustion chamber 298 and surge chamber 2100. Flange 2104 includes a plurality of passageways 2106, only two of which are depicted. A flange 2108 is positioned between combustion chamber 2102 and surge chamber 2100. Flange 2108 includes a plurality of passageways 2110, only two of which are depicted. Detonating cord 276 passes through an opening in the center flanges 2104, 2108.

Upper housing section 284 includes a plurality of openings 2112, only two of which are visible in FIG. 8. Openings 2112 allow for fluid communication between exterior 282 and surge chamber 2100. A sliding sleeve 2114 is fitted within upper housing section 284 to selectively allow and prevent fluid communication through openings 2112. In the illustrated closed position of surge chamber assembly 270, shear pins 2116 secure sliding sleeve 2114 to flange 2104. It should be appreciated by those skilled in the art that although only two shear pins 2116 are illustrated and described, any number of shear pins may be utilized in accordance with the force desired to shift sliding sleeve 2114. In the closed position, a pair of seals 2118, 2120 prevent fluid communications through openings 2112. In addition, a biasing member such as snap ring 2122 is positioned exteriorly of sleeve 2114. Passageways 2106 through flange 2104 provide for fluid communication between combustion chamber 298 and sliding sleeve 2114.

A combustible element which is illustrated as a propellant 2124 is positioned within combustion chamber 298 and secured in place with a propellant sleeve 2126. Preferably, propellant 2124 is a substance or mixture that has the capacity for extremely rapid but controlled combustion that produces a combustion event including the production of a large volume of gas at high temperature and pressure. Propellant 2124 is preferably a solid but may be a liquid or combination thereof. In an exemplary embodiment, propellant 2124 comprises a solid propellant such as nitrocellulose plasticized with nitroglycerin or various phthalates and inorganic salts suspended in a plastic or synthetic rubber and containing a finely divided metal. Moreover, in this exemplary embodiment, propellant 2124 may comprise inorganic oxidizers such as ammonium and potassium nitrates and perchlorates. Most preferably, potassium perchlorate is employed. It should be appreciated, however, that substances other than propellants may be utilized. For example, explosives such as black powder or powder charges may be utilized.

Lower housing section 292 includes a plurality of openings 2128, only two of which are visible in FIG. 8. Openings 2128 allow for fluid communication between exterior 282 and surge chamber 2100. A sliding sleeve 2130 is fitted within lower housing section 292 to selectively allow and prevent fluid communication through openings 2128. In the illustrated closed position of surge chamber assembly 270, shear pins 2132 secure sliding sleeve 2130 to flange 2108. In the closed position, a pair of seals 2134, 2136 prevent fluid communications through openings 2128. In addition, a biasing member such as a snap ring 2138 is positioned exteriorly of sliding sleeve 2130. Passageways 2110 through flange 2108 provide for fluid communication between combustion chamber 2102 and sliding sleeve 2130. A combustible element which is illustrated as a propellant 2140 is positioned within combustion chamber 2102 and secured in place with a propellant sleeve 2142.

The operation of the surge chamber assembly 270 of the present invention will now be described. When it is desirable to operate surge chamber assembly 270, an explosion in the form of a detonation is propagated through surge chamber assembly 270 via detonating cord 276. As one skilled in the art will appreciate, the explosion of detonation cord 276 is an extremely rapid, self-propagating decomposition of detonating cord 276 that creates a high-pressure-temperature wave that moves rapidly through surge chamber assembly 270. The explosion of detonating cord 276 ignites propellant 2124 and causes a combustion once propellant 2124 reaches its autoignition point, i.e., the minimum temperature required to initiate or cause self-sustained combustion.

When the explosion of detonation cord 276 is within combustive proximity of propellant 2124, propellant 2124 ignites. The combustion of propellant 2124 produces a large volume of gas which pressurizes combustion chamber 298. As one skilled in the art will also appreciate, the combustion of propellant 2124 is an exothermic oxidation reaction that yields large volumes of gaseous end products of oxides at high pressure and temperature. In particular, the volume of oxides created by the combustion of propellant 2124 within combustion chamber 298 provides the force required to actuate sliding sleeve 2114. More specifically, the pressure within combustion chamber 298 acts on sliding sleeve 2114 until the force generated is sufficient to break shear pins 2116. Once shear pins 2116 are broken, sliding sleeve 2114 is actuated to an open position such that openings 2112 are not obstructed and fluid communication from exterior 282 to surge chamber 2100 is allowed. The lower portion of upper housing section 284 includes a radially expanded region 2144 that defines a shoulder 2146. As sliding sleeve 2114 slides into contact with the upper end of connector 286, snap ring 2122 expands to prevent further axial movement of sleeve 2114.

Likewise, as best seen in FIG. 8, when the explosion of detonation cord 276 is within combustive proximity of propellant 2140, propellant 2140 ignites. The combustion of propellant 2140 produces a large volume of gas which pressurizes combustion chamber 2102. The pressure within combustion chamber 2102 acts on sliding sleeve 2130 until the force generated is sufficient to break shear pins 2132. Once shear pins 2132 are broken, sliding sleeve 2130 is actuated to an open position such that openings 2128 are not obstructed and fluid communication from exterior 282 to surge chamber 2100 is allowed. In the illustrated embodiment, the lower portion of upper housing section 292 includes a radially expanded region 2148 that defines a shoulder 2150. As sliding sleeve 2130 slides into contact with the lower end of connector 290, snap ring 2138 expands to prevent further axial movement of sliding sleeve 2130.

Prior to detonation of detonating cord 276, the wellbore in which the gun string and one or more surge chamber assemblies 270 is positioned may preferably be in an overbalanced condition. During operation, a series of perforating guns and surge chamber assemblies 270 operate substantially simultaneously. This operation allows fluids from within the wellbore to enter the surge chambers which dynamically creates an underbalanced pressure condition. This permits the perforation discharge debris to be cleaned out of the perforation tunnels due to the fluid surge from the formation into the surge chambers. The cleansing inflow continues until a stasis is reached between the pressure in the formation and the pressure within the casing. Hence, surge chamber assembly 270 of the present invention ensures clean perforation tunnels by providing a dynamic underbalanced condition. Addition series of perforating guns and surge chamber assemblies 270 may thereafter be operated which will again dynamically create an underbalanced pressure condition for the newly shot perforations.

The first surge chamber 106 comprises an interior volume or space that receives an in-flow of wellbore fluids when the vent door of the surge vent sub-assembly 104 opens. In an embodiment, the first surge chamber 106 is filled with a gas at ambient surface pressure, for example air or nitrogen. In an embodiment, the first surge chamber 106 may provide the functionality of a spacer to separate two perforation guns by a distance selected to perforate the wellbore at different production levels. In an embodiment, the first surge chamber 106 may provide an excess of surge volume for a particular perforation job. Stated in another way, the first surge chamber 106 alone may not be suitable for achieving the surge profile determined by an engineering tool, for example a well completion modeling and engineering tool that executes on a computer such as a desktop computer and/or workstation. In such a case, it may be desirable to limit the surge volume of the first surge chamber 106 and/or limit the in-flow rate of wellbore fluids into the first surge chamber 106, for example by using one or more surge attenuation systems.

While in the description of the downhole oilfield completion tool 100 described above, the first perforation gun 102 is a component of the tool 100, in another embodiment the tool 100 may not comprise the first perforation gun 102 and may comprise the surge vent sub-assembly 104 and the first surge chamber 106. For example, in some circumstances it may be that the work string 108 is lowered into the well with the tool 100 attached in a separate operation after the wellbore has been perforated. In this case, the activation of the surge vent sub-assembly 104 to open the port to surge the well and admit wellbore fluid into the first surge chamber 106 may occur at a time later than the perforation of the wellbore.

Figure 2:
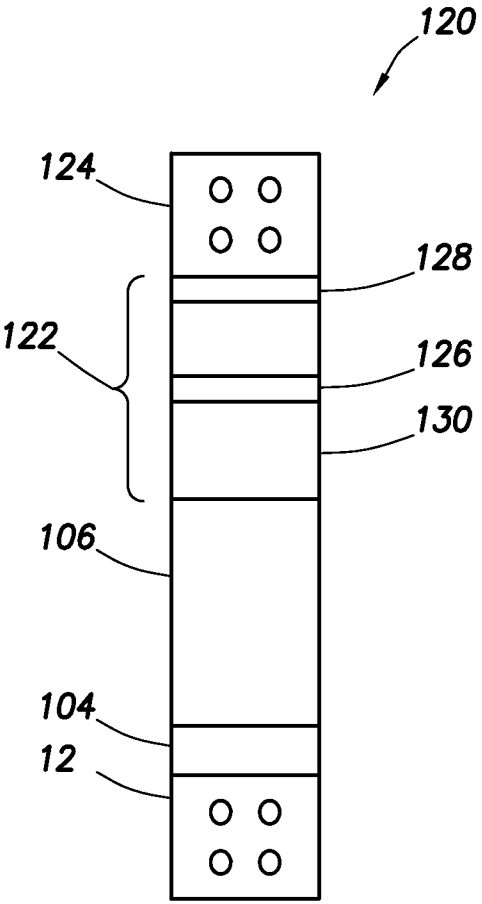
FIG. 2 is an illustration of another downhole completion tool according to an embodiment of the disclosure.

Turning now to FIG. 2, a second downhole oilfield completion tool 120 is described. The second downhole oilfield completion tool 120 comprises the first perforation gun 102, the surge vent sub-assembly 104, the first surge chamber 106, a second surge chamber 122, and a second perforation gun 124. While not shown, the second downhole oilfield completion tool 120 may be connected to a work string such as 108. In an embodiment, additional surge chambers similar to the first surge chamber 106 and/or the second surge chamber 122 may be included in the second downhole oilfield completion tool 120, for example to provide appropriate spacing between the first perforation gun 102 and the second perforation gun 124. In another embodiment, however, the second downhole oilfield completion tool 120 may not have any perforation gun 102, 124 and may comprise the surge vent subassembly 104, the first surge chamber 106, and the second surge chamber 122, for example when the wellbore is first shot with perforation guns and then later surged with the second downhole oilfield completion tool 120.

In the oilfield second downhole oilfield completion tool 120, it is contemplated that the surge volume comprising the volume of the first surge chamber 106 and the second surge chamber 122 may produce an excessive surge in some wellbore perforation operations, for example a surge which does not approximate a surge profile determined by a computer program used to design, at least in part, the second downhole oilfield completion tool 120. Accordingly, the second surge chamber 122 comprises a first isolator 126 and a second isolator 128. The isolators 126, 128 may be referred to in some contexts as bulkheads. The isolators 126, 128 may also be referred to in some contexts as sealed initiators. The isolators 126, 128 are configured to block passage of fluid, for example wellbore fluids, but to propagate a detonation. Thus, as depicted in FIG. 2, the surge volume of the second downhole oilfield completion tool 120 comprises the volume of the first surge chamber 106 plus a partial surge chamber volume 130 that may comprise about half of the volume of the second surge chamber 122. One skilled in the art will readily appreciate that by locating the first isolator 126 at different positions along the second surge chamber 122, the partial surge chamber volume 130 of the second surge chamber 122 can be adjusted based on the optimum surge profile. Additionally, a series of coupled surge chambers may employ similar isolators and/or isolation devices to exclude wellbore fluid in flow from portions of several surge chambers or from a contiguous series of two or more surge chambers, based on the optimum surge profile determined for a specific perforation operation.

Figure 3:
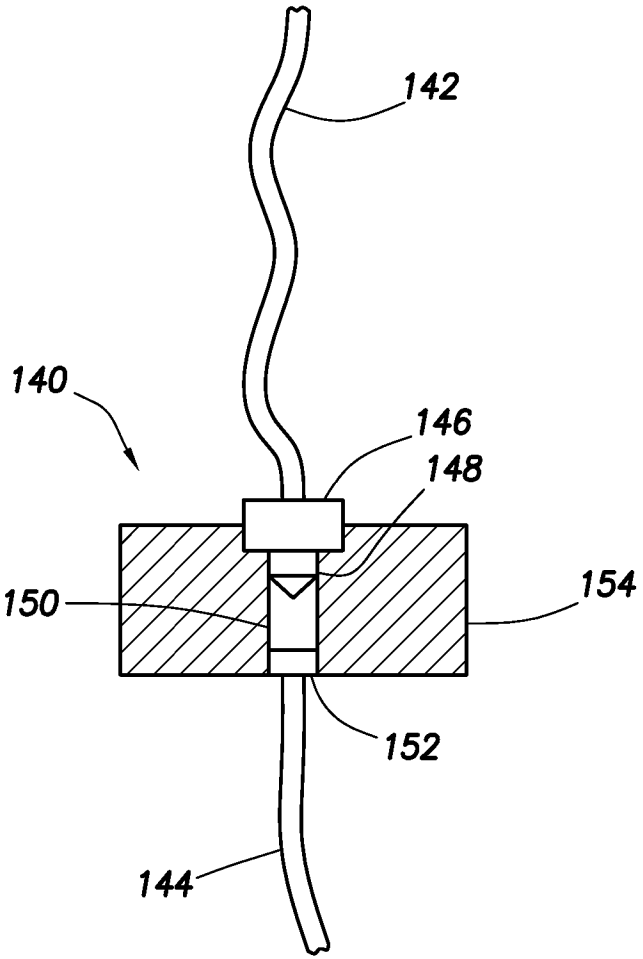
FIG. 3 is an illustration of a isolator according to an embodiment of the disclosure.

Turning now to FIG. 3, some details of an isolator 140 are described. A detonation may be propagated from a first detonating cord 142 to a second detonating cord 144 through the isolator 140. The first detonating cord 142 may ignite an explosive component 146. The ignited explosive component 146 drives a firing pin 148 constrained in a race or tunnel 150 to impact into a percussion device 152, detonating the percussion device 152. The explosive component 146, firing pin 148, the race 150, and the percussion device 152 may be contained in a bulkhead 154 that is operable to block passage of fluid flow. When detonated, the percussion device 152 ignites the second detonating cord 144, whereby the detonation is propagated from the first detonating cord 142 to the second detonating cord 144 across the isolator 140. The isolator 140 is designed to sealingly block propagation of fluids across the isolator 140, in either direction, when installed in the surge chamber 106, 122. While a simple embodiment of the isolator 140 has been illustrated and described, those skilled in the art will readily appreciate that a variety of alternative embodiments would be suitable to the use for controlling a surge volume as described above with reference to FIG. 2.

Figure 4A:
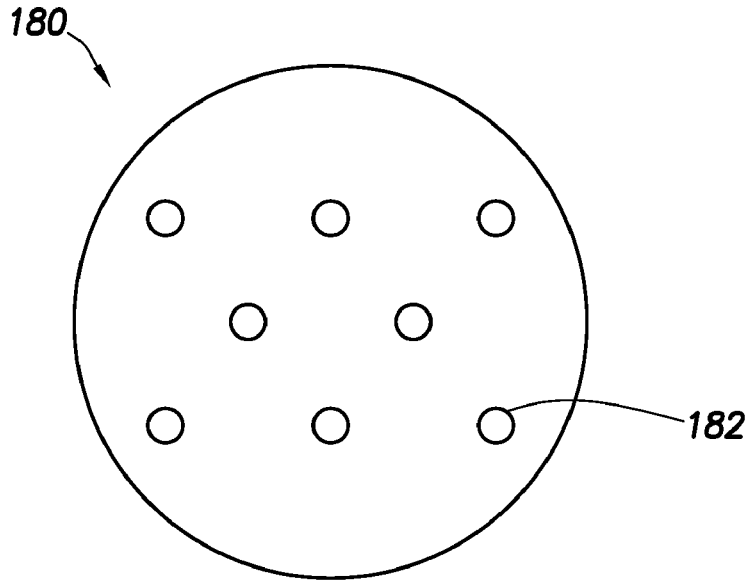
FIG. 4A is an illustration of a constrictor plate according to an embodiment of the disclosure.
Figure 4B:
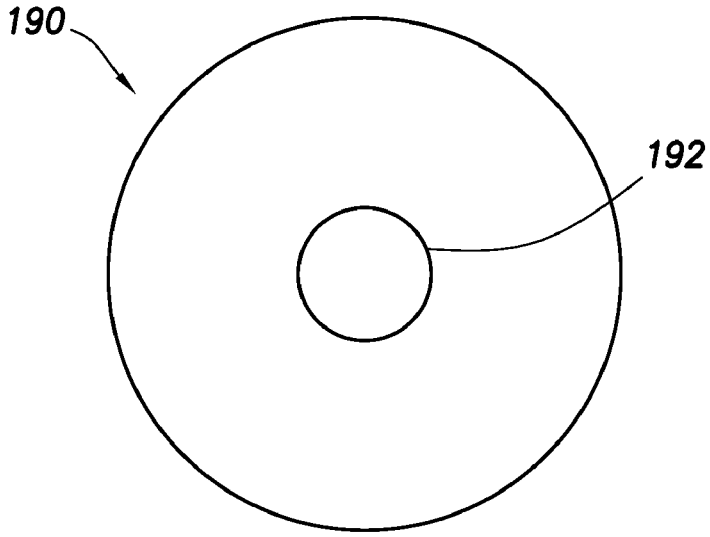
FIG. 4B is an illustration of a constrictor plate according to another embodiment of the disclosure.

Turning now to FIG. 4A and FIG. 4B, a plurality of surge constrictors are described. A first constrictor plate 180 having a plurality of holes 182 may be assembled into the first surge chamber 106 to attenuate the rate of wellbore fluid in-flow within the first surge chamber 106, thereby controlling surge in accordance with the optimum surge profile. One skilled in the art will readily appreciate that the number and size of holes 182 may be adjusted to vary the desired rate of wellbore fluid in-flow in accordance with the optimum surge profile. A second constrictor plate 190 having a single hole 192 may be assembled into the first surge chamber 106 to attenuate the rate of wellbore fluid in-flow within the first surge chamber 106, thereby controlling surge in accordance with the optimum surge profile. One skilled in the art will readily appreciate that the size of hole 192 may be adjusted to vary the desired rate of wellbore fluid in-flow in accordance with the optimum surge profile. The shape of the holes 182 and the hole 192 may be altered to rectangles, ovals, or other shapes arbitrarily without affecting the general function of constricting wellbore fluid in-flow.

In an embodiment the constrictor plate 180, 190 may be installed and/or configured into the interior of the first surge chamber 106 at a selected point to promote achieving at least a portion of a preferred surge profile. Depending on where the constrictor plate 180 is installed within the first surge chamber 106, there is more or less free volume of the first surge chamber 106 for wellbore fluid to enter into the first surge chamber 106 before being constrained to flow through the constrictor plate 180 into a constrained volume of the first surge chamber 106. The position of the constrictor plate 180 can be changed to either increase or decrease the free volume of the first surge chamber 106 and to either decrease of increase the constricted volume of the first surge chamber 106. It is understood that the constrictor plate 180, 190 may be said to have an effect on wellbore fluid flow within the first surge chamber 106, as for example an effect on wellbore fluid flowing from the free volume portion of the first surge chamber 106 through the constrictor plate 180, 190 to the restricted volume portion of the first surge chamber 106, as well as an effect on wellbore fluid flow into the first surge chamber 106, as for example an effect on how quickly wellbore fluid flows into the first surge chamber 106 from outside the first surge chamber 106.

Figure 5A:
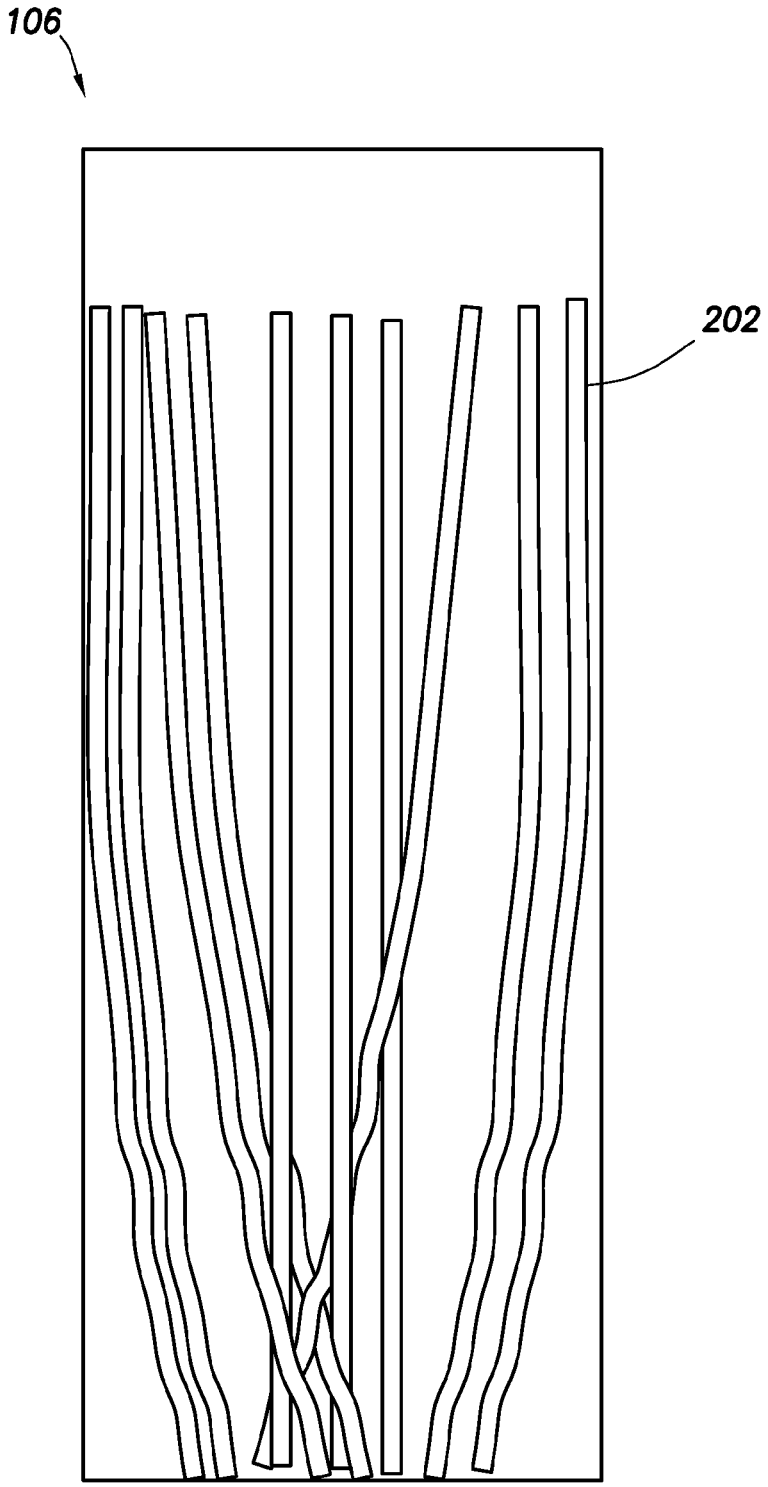
FIG. 5A is an illustration of a volume filler according to an embodiment of the disclosure.
Figure 5B:
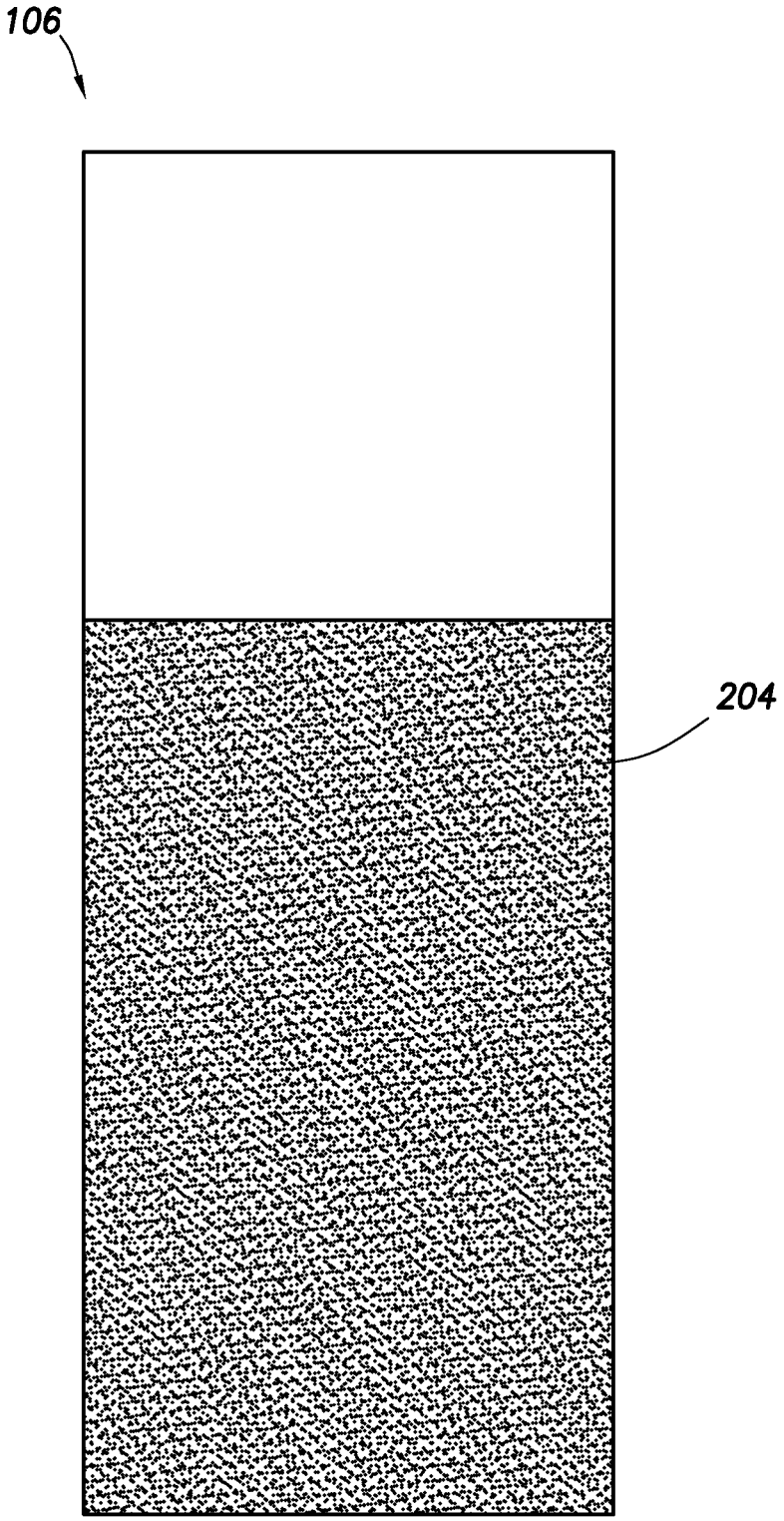
FIG. 5B is an illustration of a volume filler according to another embodiment of the disclosure.
Figure 5C:
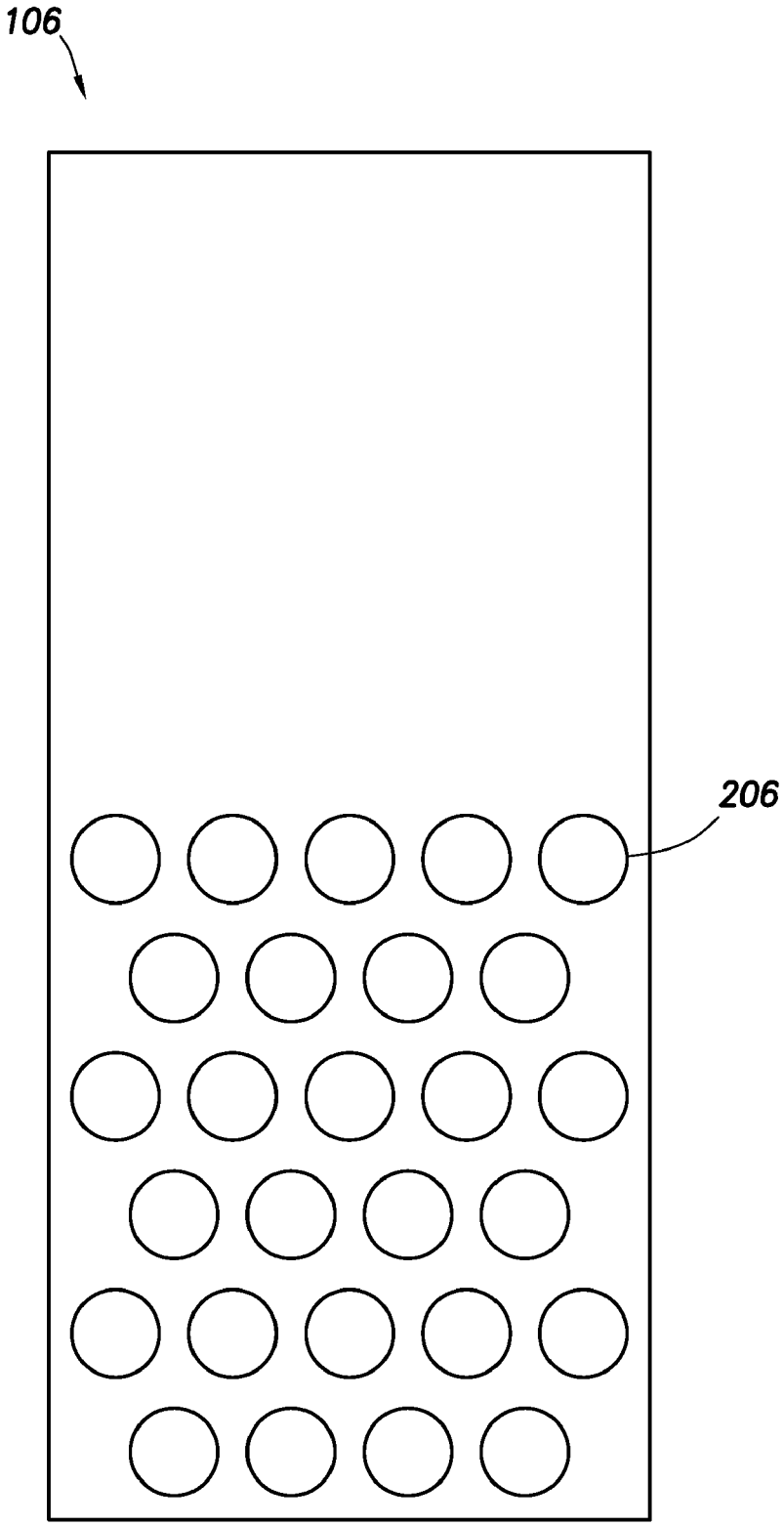
FIG. 5C is an illustration of a volume filler according to another embodiment of the disclosure.

Turning now to FIG. 5A, FIG. 5B, and FIG. 5C, a plurality of surge volume fillers are described. An effective plurality of metal rods 202 may be added to the interior of the first surge chamber 106 to reduce the surge volume in conformance with the optimum surge profile. An effective volume of proppant material 204 may be added to the interior of the first surge chamber 106 to reduce the surge volume in conformance with the optimum surge profile. An effective volume of metal balls 206 or other shapes may be added to the interior of the first surge chamber 106 to reduce the surge volume in conformance with the optimum surge profile. One skilled in the art will readily appreciate that the amount of filler materials—metal rods 202, proppant material 204, metal balls 206, liquid, and other filler materials—may be adjusted to achieve the optimum surge profile. Further, one skilled in the art will appreciate that the metal rods 202, proppant material 204, metal balls 206, and liquid may have a secondary surge control effect by reducing or damping the in-flow rate of wellbore fluid during surge.

In different embodiments and/or different perforation operation jobs, one or more surge attenuation systems may be used singly and/or in combination as described above.

Figure 6:
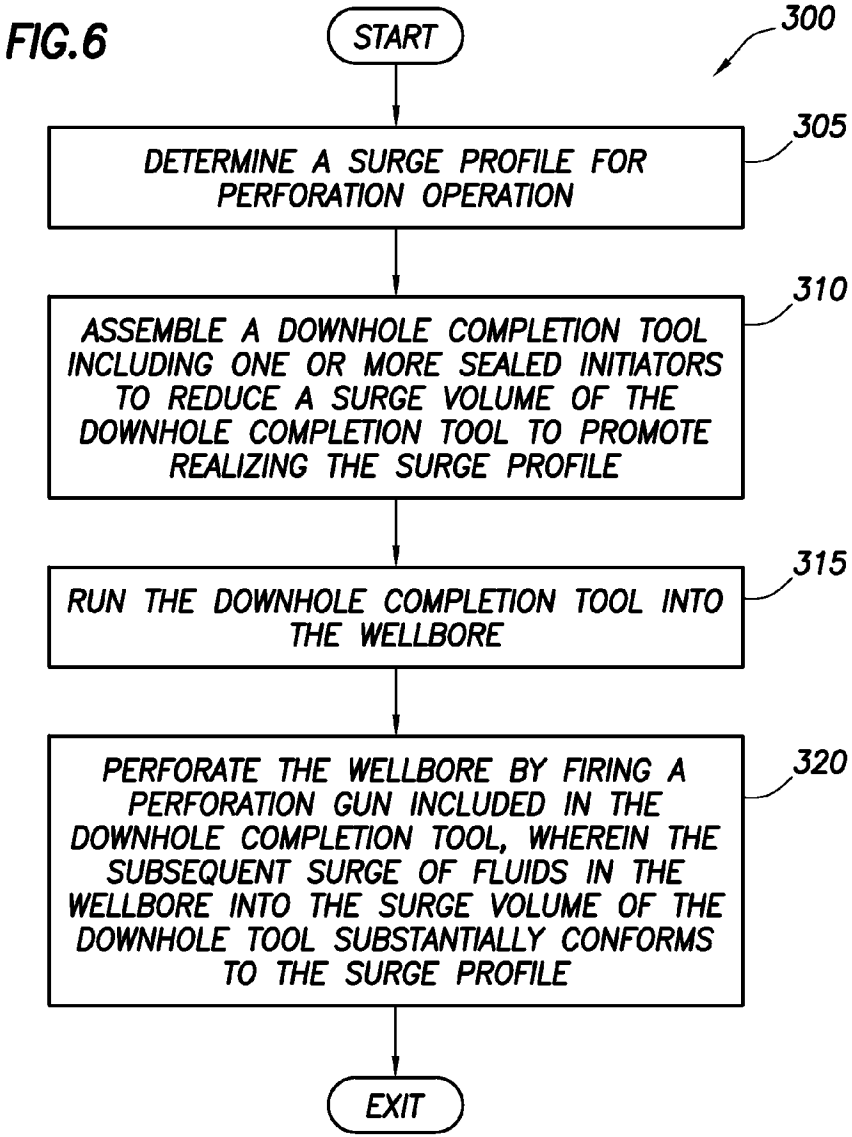
FIG. 6 is a flow chart of a method of controlling a surge profile during wellbore perforation according to an embodiment of the disclosure.

Turning now to FIG. 6, a first method 300 is described. At block 305, a surge profile for a wellbore is determined. The surge profile may be determined using an automated tool, such as a computer program, or a manual calculation method. The surge profile may be designed to promote desirable perforation operation results, for example a transient flow from the formation into the perforation tunnels into the wellbore, resulting from an underbalanced wellbore pressure condition with reference to the formation pressure, that clears some of the perforation debris from the perforation tunnels. In some circumstances, however, a perforation operation may be performed in a generally over pressure condition. The surge profile may be determined based on formation parameters, wellbore pressure parameters, and a wellbore location. The formation parameters may include a formation pressure, a formation material, and a formation density. The wellbore pressure parameters may include an expected pressure immediately before a perforation gun detonation and/or a projected wellbore pressure transient taking account of pressure fluctuations ensuing upon perforation gun detonation. The wellbore location may take account of differences observed between wellbores at different locations around the world.

At block 310, a downhole completion tool is assembled including one or more isolators, also known as sealed initiators, to reduce a surge volume of the downhole completion tool to promote realizing the surge profile. At block 315, the downhole completion tool is run into the wellbore to an appropriate depth or displacement to perforate the wellbore at a desirable production zone.

At block 320, the wellbore is perforated by firing a perforation gun contained in the downhole completion tool. The subsequence surge of wellbore fluid into the downhole completion tool substantially conforms to the surge profile determined above. In embodiment, the wellbore may first be perforated, the spent perforation gun removed from the wellbore, a completion tool containing a surge chamber lowered on a tool string into the wellbore, and the wellbore may then be surged with the surge chamber.

Figure 7:
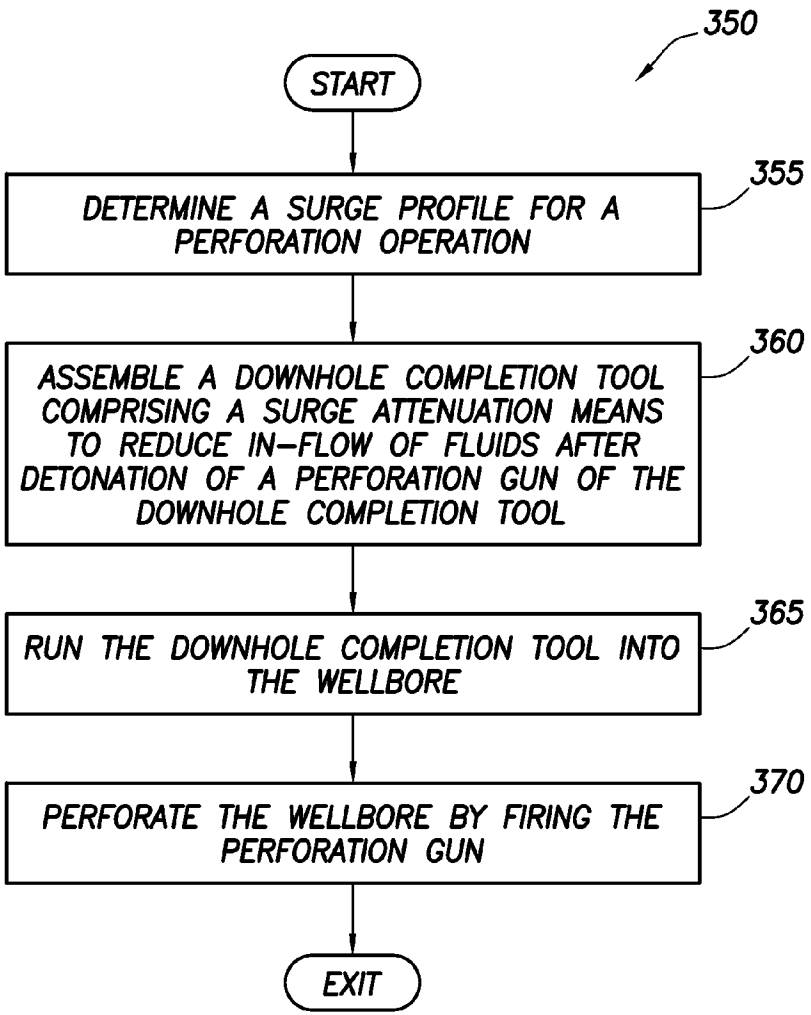
FIG. 7 is a flow chart of another method of controlling a surge profile during wellbore perforation according to an embodiment of the disclosure.

Turning now to FIG. 7, a method 350 is described. At block 355, a surge profile for a perforation operation is determined. The surge profile may be determined using an automated tool, such as a computer program, or a manual calculation method. The surge profile may be determined based on formation parameters, wellbore pressure parameters, and a wellbore location. The formation parameters may include a formation pressure, a formation material, and a formation density. The wellbore pressure parameters may include an expected pressure immediately before perforation gun detonation and/or a projected wellbore pressure transient taking account of pressure fluctuations ensuing upon perforation gun detonation. The wellbore location may take account of differences observed between wellbores at different locations around the world.

At block 360, a downhole completion tool is assembled comprising a surge attenuation system to reduce in-flow of wellbore fluids after a perforation gun in the downhole completion tool is detonated. The surge attenuation system may be provided by a constrictor plate installed in the downhole completion tool that limits the rate of in-flow of wellbore fluids into a surge chamber contained in the downhole completion tool. The surge attenuation system may be provided by a compressible, a semi-compressible, or an uncompressible fluid contained within a surge chamber of the downhole completion tool. The surge attenuation system may be provided by an adjustable surge vent, the surge vent being configurable to open to different fractions from a fully closed to a fully opened position. The surge attenuation system may be provided by limiting a surge volume of an interior of a surge chamber, for example by blocking at least a portion of the surge chamber to in-flow of wellbore fluid with isolators. The surge volume of the interior of the surge chamber may also be limited by placing filler material such as metal bars, proppant material, and/or metal balls in the surge chamber prior to assembling the downhole completion tool.

At block 365, the downhole completion tool is run into the wellbore to an appropriate depth or displacement to perforate the wellbore at a desirable production zone.

At block 370, the wellbore is perforated by firing a perforation gun contained in the downhole completion tool.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A downhole oilfield completion method, comprising:

determining a surge profile for a wellbore;

assembling a downhole completion tool having a surge chamber that defines an interior volume initially isolated from wellbore fluid and comprising a surge attenuation system that comprises a component disposed within the interior volume of the surge chamber to define a first volume and a second volume of the interior volume, the surge attenuation system operable to reduce a surge of the downhole completion tool based at least in part on the surge profile;

running the downhole completion tool into the wellbore; and surging the wellbore by admitting wellbore fluid into a surge volume of the surge chamber, the surge reduced at least in part by the surge attenuation system.

2. The downhole oilfield completion method of claim 1, wherein the component comprises an at least one constrictor plate.

3. The downhole oilfield completion method of claim 2, wherein the at least one constrictor plate is disposed within the interior volume of the surge chamber sub-assembly based on the surge profile of the wellbore to define the first volume as a free surge chamber volume of the surge volume and the second volume as a restricted surge chamber volume of the surge volume.

4. The downhole oilfield completion method of claim 3, wherein the surge volume is the combination of the first volume and the second volume.

5. The downhole oilfield completion method of claim 1, wherein the surge attenuation system further comprises a vent sub-assembly, wherein the vent sub-assembly is configured to admit in-flow of wellbore fluids into the surge volume at a pre-defined rate.

6. The downhole oilfield completion method of claim 1, wherein the component comprises at least one isolator that blocks the in-flow of wellbore fluids into the second volume to reduce the surge volume.

7. The method of claim 6, wherein the at least one isolator provides a bulkhead detonation functionality operable to propagate a detonation signal while blocking the in-flow of wellbore fluids.

8. The downhole oilfield completion method of claim 6, wherein the first volume is the surge volume.

9. The downhole oilfield completion method of claim 1, wherein the component comprises a quantity of a filler material disposed within the second volume of the surge chamber to reduce the surge volume.

10. The downhole oilfield completion method of claim 9, wherein the first volume is the surge volume.

11. The downhole oilfield completion method of claim 1, wherein the downhole completion tool further comprises a perforating gun and further including perforating the wellbore with the perforating gun, wherein a surge of fluids in the wellbore into the surge volume of the completion tool subsequent to a detonation of charges comprising the perforating gun is designed to conform to the surge profile.

12. A downhole oilfield completion method, comprising:

determining a surge profile for a wellbore;

assembling a downhole completion tool having an interior surge volume and comprising a surge attenuation system operable to reduce a surge of the downhole completion tool based at least in part on the surge profile;

running the downhole completion tool into the wellbore; and surging the wellbore by admitting wellbore fluid into the interior surge volume, the surge reduced at least in part by the surge attenuation system, wherein the downhole completion tool further comprises a surge chamber sub-assembly defining the interior surge volume, wherein the surge attenuation system comprises an adjustable quantity of a filler material disposed within the surge chamber sub-assembly, wherein the filler material comprises at least one of proppant material, metal rods, metal balls, and liquid.

13. An oilfield downhole completion tool, comprising:

a surge chamber that defines an interior volume initially isolated from wellbore fluid and containing at least one constrictor plate to reduce the in-flow of wellbore fluid within the surge chamber when a well is surged, wherein the at least one constrictor plate is positioned within the surge chamber to define a free surge chamber volume and a restricted surge chamber volume.

14. The tool of claim 13, wherein the completion tool further comprises a surge vent sub-assembly coupled to the surge chamber, the surge vent sub-assembly containing a propellant operable to open a port of the surge vent sub-assembly subsequent to firing the perforation gun, the open port operable to admit in-flow of wellbore fluid to the surge chamber.

15. The tool of claim 13, further comprising an at least one perforation gun.

16. The tool of claim 15, further comprising an at least one additional perforation gun and an at least one additional surge chamber, wherein the plurality of surge chambers provide a spacing between the plurality of perforation guns designed to align the plurality of perforation guns with designed production zones of the wellbore.

17. The tool of claim 13, wherein the at least one constrictor plate is positioned within the surge chamber based on a surge profile of a wellbore.

18. A downhole oilfield tool, comprising:

a first perforation gun;

a surge chamber sub-assembly comprising a pre-determined volume of filler material and a surge volume at approximately atmospheric pressure; and a surge vent sub-assembly coupled to the first perforation gun and coupled to the surge chamber sub-assembly, wherein the surge vent sub-assembly is operable to open a surge vent in association with detonating the first perforation gun, thereby admitting a surge of a fluid in the wellbore into the surge chamber sub-assembly.

19. The downhole oilfield tool of claim 18, wherein the filler material comprises uncompressible proppant material.

20. The downhole oilfield tool of claim 18, wherein the filler material comprises a plurality of metal rods.

21. The downhole oilfield tool of claim 18, further including a second perforation gun and wherein the surge chamber sub-assembly forms at least part of a spacer sub-assembly, wherein the spacer sub-assembly is designed to separate the first perforation gun and the second perforation gun by a distance corresponding to a distance between a first production zone of the wellbore and a second production zone of the wellbore.

22. The downhole oilfield tool of claim 18, wherein the pre-determined volume of filler material is determined to achieve a surge profile during a wellbore perforation operation, wherein the surge profile is determined using a computer program based, at least in part, on a wellbore pressure before firing the first perforation gun, a formation pressure, and a formation matrix composition.

23. The downhole oilfield tool of claim 22, wherein the surge profile is determined further based on a well location.

24. The downhole oilfield tool of claim 18, wherein the surge vent comprises a vent explosive charge coupled to a vent sleeve, wherein the vent explosive charge is ignited after the first perforation gun is fired, the vent explosive charge driving the vent sleeve open, suddenly opening the surge chamber sub-assembly and creating a pressure proximate a perforation zone created by firing the first perforation gun that is substantially less than a pressure of a formation.

* * * * *